US007556530B2

(12) United States Patent
Moritake et al.

(10) Patent No.: US 7,556,530 B2
(45) Date of Patent: Jul. 7, 2009

(54) CONNECTOR IN WHICH DEFECTIVE ELECTRICAL CONNECTION BETWEEN A PLURALITY OF SHELL COMPONENTS IS SUPPRESSED

(75) Inventors: Toshiyuki Moritake, Tokyo (JP); Tetsu Urano, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/012,356

(22) Filed: Feb. 1, 2008

(65) Prior Publication Data

US 2008/0188129 A1 Aug. 7, 2008

(51) Int. Cl.
*H01R 13/648* (2006.01)

(52) U.S. Cl. ..... 439/607; 439/74

(58) Field of Classification Search ..... 439/74, 439/638, 607

See application file for complete search history.

(56) References Cited

U.S. PATENT DOCUMENTS 6,554,648 B2 * 4/2003 Shi et al. ..... 439/607
6,705,893 B1 * 3/2004 Ko ..... 439/607
6,749,463 B1 * 6/2004 Fan ..... 439/607
6,899,565 B2 * 5/2005 Kodera et al. ..... 439/607
6,908,339 B2 6/2005 Tanaka
6,939,148 B2 * 9/2005 Yu ..... 439/92
7,018,237 B2 * 3/2006 Zhan et al. ..... 439/607
7,150,648 B1 * 12/2006 Hall et al. ..... 439/581
7,229,298 B2 * 6/2007 Shen et al. ..... 439/95

FOREIGN PATENT DOCUMENTS

JP 8-162218 6/1996
JP 8-213107 8/1996
JP 9-134761 5/1997
JP 11-121094 4/1999
JP 2002-280125 9/2002
JP 2005-056780 3/2005

OTHER PUBLICATIONS

Japanese Office Action dated Dec. 3, 2008.

* cited by examiner

*Primary Examiner*—Thanh-Tam T Le
(74) *Attorney, Agent, or Firm*—Collard & Roe, P.C.

(57) ABSTRACT

In a connector including a housing holding a contact, a shell covers the contact and the housing. The housing includes a protecting portion. The shell includes a first shell which includes a first contacting portion, and a second shell which includes a second contacting portion brought into contact with the first contacting portion in the protecting portion.

11 Claims, 4 Drawing Sheets

CONNECTOR IN WHICH DEFECTIVE ELECTRICAL CONNECTION BETWEEN A PLURALITY OF SHELL COMPONENTS IS SUPPRESSED

This application claims priority to prior Japanese patent application JP 2007-24049, filed on Feb. 2, 2007, the disclosure of which is incorporated herein in its entirety by reference.

BACKGROUND OF THE INVENTION

This invention relates to a connector having a conductive shell disposed outside a connector body and, in particular, to a connector having a shell comprising a plurality of shell components.

A connector of the type is described in Japanese Unexamined Patent Application Publication (JP-A) No. H11-121094 and comprises a connector body connected to a cable and a shell disposed outside the connector body. The shell comprises a conductive upper shell fitted over the connector body from an upper side and a conductive lower shell fitted over the connector body from a lower side. The upper and the lower shells are electrically connected to each other when they are fitted over the connector body. In detail, the upper shell is provided with a leaf spring which is brought into contact with a side surface of the lower shell so that the upper and the lower shells are combined into an electrically integral structure.

SUMMARY OF THE INVENTION

However, the above-mentioned leaf spring may be subjected to undesired deformation under external force during assembling of the connector, during manufacture of the shell, and so on. In that event, mechanical contact of the leaf spring is unstable so that electrical connection between the upper and the lower shells may become defective.

It is therefore an exemplary object of this invention to provide a connector in which defective electrical connection between a plurality of shell components is suppressed.

Other objects of the present invention will become clear as the description proceeds.

According to an exemplary aspect of the present invention, there is provided a connector comprising a contact, a housing holding the contact, and a shell covering the contact and the housing, wherein the housing includes a protecting portion, and wherein the shell comprises a first shell which includes a first contacting portion and a second shell which includes a second contacting portion brought into contact with the first contacting portion in the protecting portion.

DESCRIPTION OF THE EXEMPLARY EMBODIMENTS

Referring to FIGS. 1A to 1E, description will be made of a connector according to a first exemplary embodiment of this invention.

Figure 1A:
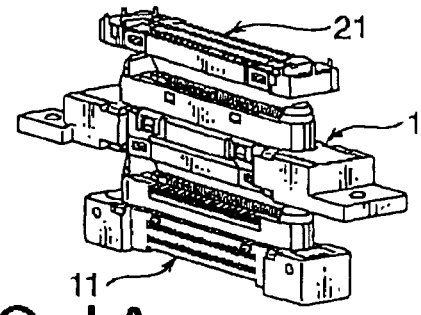
FIG. 1A is a perspective view of a relay connector as a connector according to a first exemplary embodiment of this invention, together with a plug connector and a receptacle connector.

The connector 1 is a so-called relay connector for connecting a plug connector 11 and a receptacle connector 21 to each other. As illustrated in FIG. 1A, the plug connector 11 is placed below the connector 1. The receptacle connector 21 is placed above the connector 1. The connector 1 is connected to each of the plug connector 11 and the receptacle connector 21.

Figure 1B:
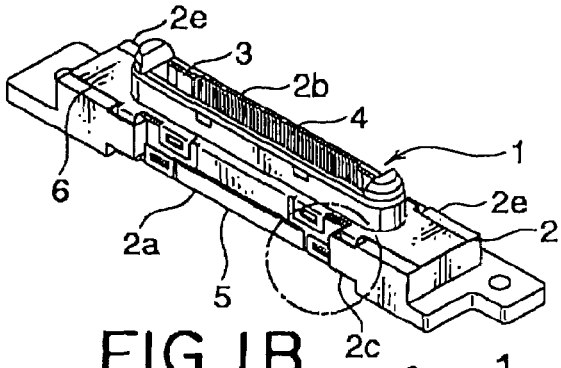
FIG. 1B is an enlarged perspective view of the relay connector illustrated in FIG. 1A.

As illustrated in FIG. 1B, the connector 1 comprises an insulating housing 2 having a center portion 2*a*. A conductive power supply contact 3 and a number of conductive signal contacts 4 are arranged on an upper surface of the center portion 2*a* and aligned in an array. The housing 2 is provided with a protruding portion 2*b* surrounding the power supply contact 3 and the signal contacts 4.

The center portion 2*a* of the housing 2 has a side surface and a lower surface which are covered with a conductive first shell 5 as a shell component. The upper surface of the center portion 2*a* and a peripheral surface of the protruding portion 2*b* are covered with a conductive second shell 6 as the other shell component. A plurality of protecting portions 2*c* are formed at four positions (in the figure, only the two positions on one side surface are illustrated). Each of the protecting portions 2*c* is provided with a flange portion 2*e*. A combination of the first and the second shells 5 and 6 may be called a shell.

The first shell 5 is connected to a plug shell (not shown) of the plug connector 11 to be electrically connected thereto. The second shell 6 is connected to a receptacle shell (not shown) of the receptacle connector 21 to be electrically connected thereto.

Figure 1C:
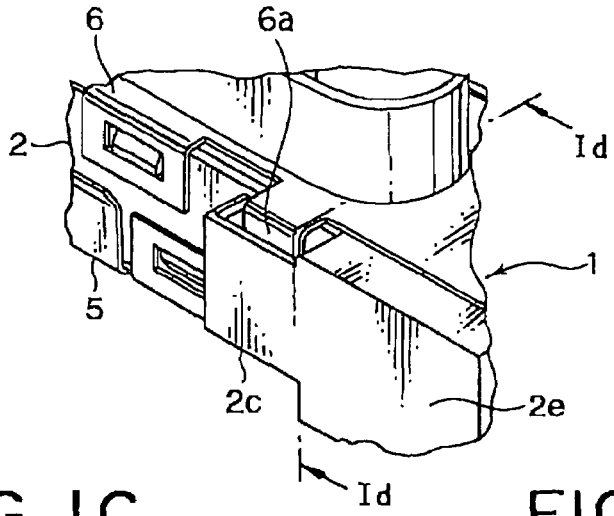
FIG. 1C is an enlarged view of only a characteristic part of the relay connector in FIG. 1B.
Figure 1D:
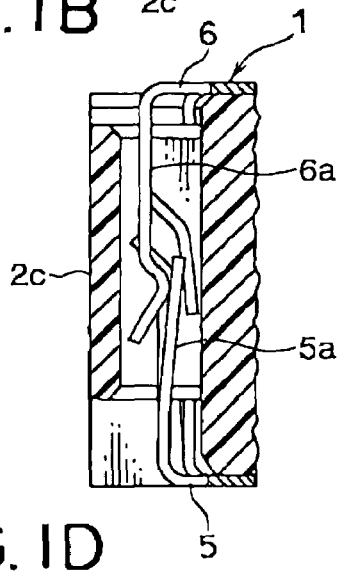
FIG. 1D is an enlarged sectional view taken along a line Id-Id in FIG. 1C.

Referring to FIGS. 1C and 1D, each of the protecting portions 2*c* is of a tubular shape having a generally rectangular section. Each of the protecting portions 2*c* defines a hollow space therein which is extended and penetrated in a fitting direction along which the connector 1 is connected to each of the plug and the receptacle connectors 11 and 21 as a mating connector. The first and the second shells 5 and 6 include first and second contacting portions 5*a* and 6*a*, respectively, which are inserted in the hollow space that is defined by each protecting portions 2*c*. Thus, the first and the second contacting portions 5*a* and 6*a* are surrounded and protected by the protecting portions 2*c*.

As illustrated in FIG. 1D, the first contacting portion 5*a* of the first shell 5 and the second contacting portion 6*a* of the second shell 6 are brought into contact with each other in the protecting portion 2*c*.

Figure 1E:
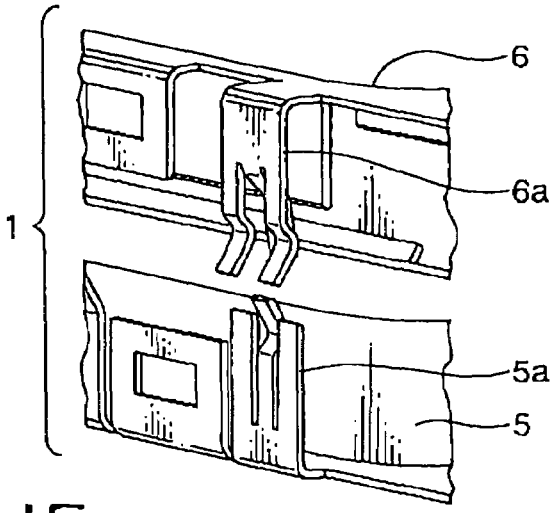
FIG. 1E is an enlarged perspective view of only a characteristic part of a shell of the relay connector in FIG. 1B in a disassembled state.

Referring to FIG. 1E, the first contacting portion 5*a* of the first shell 5 and the second contacting portion 6*a* of the second shell 6 are faced to each other before they are brought into contact with each other. The first and the second contacting portions 5*a* and 6*a* are curved into a convex shape so that they are contacted with each other with a desired pressure and that forward, backward, leftward, and rightward movement beyond a predetermined range is inhibited. Furthermore, the first and the second contacting portions 5*a* and 6*a* have a trifurcated shape. The above-mentioned configuration will become clearer by other exemplary embodiments which will later be described.

In the structure described in connection with FIGS. 1A to 1E, even if the first and the second contacting portions 5*a* and 6*a* are deformed to some extent, for example, during manufacture of the first and the second shells 5 and 6, end portions of the first and the second contacting portions 5*a* and 6*a* are pressed by walls of the protecting portion 2*c* so that the first and the second contacting portions 5*a* and 6*a* are displaced towards each other to be brought into contact. Thus, electrical connection is reliably achieved.

Figure 2:
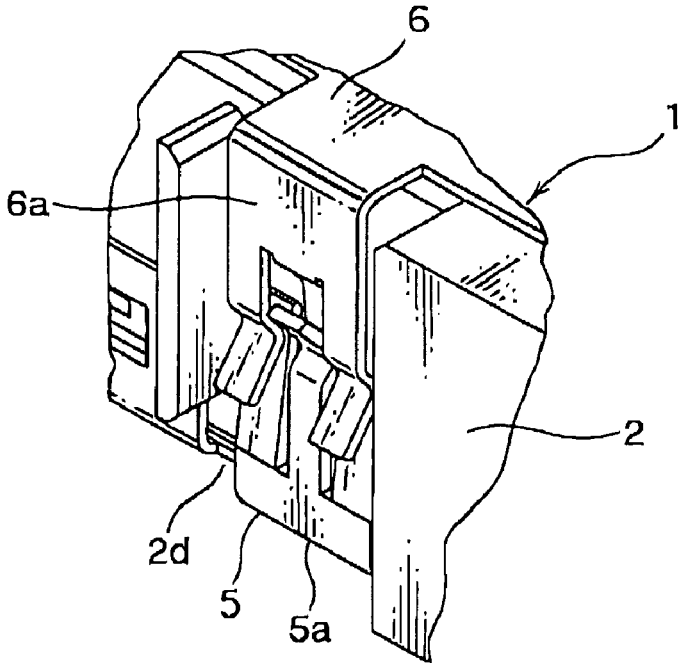
FIG. 2 is an enlarged perspective view of only a characteristic part of a connector according to a second exemplary embodiment of this invention.

Referring to FIG. 2, description will be made of a connector according to a second exemplary embodiment of this invention. The connector according to the second exemplary embodiment of this invention is also a relay connector similar to the connector illustrated in FIGS. 1A to 1E and, therefore, depicted by the same reference numeral 1. Similar parts are designated by like reference numerals and description thereof may be omitted.

In the connector illustrated in FIGS. 1A to 1E, the protecting portion 2*c* is formed into a tubular shape having a generally rectangular section. On the other hand, in the connector illustrated in FIG. 2, a protecting portion 2*d* is formed as a groove having a generally U-shaped section. Both of the first and the second contacting portions 5*a* and 6*a* are disposed in the protecting portion 2*d* of a groove type. Therefore, the state of contact between the first and the second contacting portions 5*a* and 6*a* can be visually observed from a front side.

With the structure described in connection with FIG. 2, even if the first and the second contacting portions 5*a* and 6*a* are deformed to some extent, for example, during manufacture of the first and the second shells 5 and 6, end portions of the first and the second contacting portions 5*a* and 6*a* are pressed to each other so that the first and the second contacting portions 5*a* and 6*a* are displaced towards each other to be brought into contact. Thus, electrical connection is reliably achieved.

Next referring to FIGS. 3A and 3B, a first modification of the shell will be described. Similar parts are designated by like reference numerals and description thereof will be omitted.

Figure 3A:
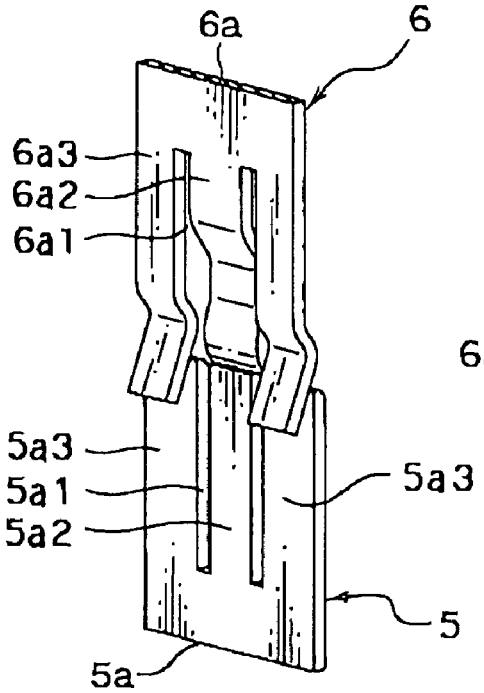
FIG. 3A is an enlarged perspective view of only a characteristic part of a first modification of the shell.

As illustrated in FIG. 3A, the first contacting portion 5*a* is formed as a rectangular flat plate as a whole. The first contacting portion 5*a* has two slits 5*a*1 cut from its upper end to form a center section 5*a*2 and a pair of side sections 5*a*3 on left and right sides. Similarly, the second contacting portion 6*a* has two slits 6*a*1 cut from its lower end to form a center section 6*a*2 and a pair of side sections 6*a*3 on left and right sides.

Figure 3B:
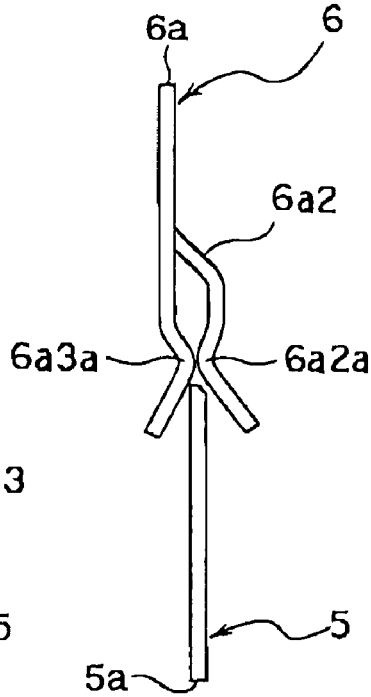
FIG. 3B is a side view corresponding to FIG. 3A.

As illustrated in FIG. 3B, the center section 6*a*2 is extended at a position near its base in parallel to the flat plate, then inclined rearward, then extended in parallel to the flat plate, and curved forward into a convex shape to form a protruding portion 6*a*2*a*. Each side section 6*a*3 is curved rearward at a position near its end to form a protruding portion 6*a*3*a*.

Each of the center section 5*a*2 and the side sections 5*a*3 of the first contacting portion 5*a* and the center section 6*a*2 and the side sections 6*a*3 of the second contacting portion 6*a* is elastically deformable in forward and backward directions. When the center section 5*a*2 and the side sections 5*a*3 of the first contacting portion 5*a* are brought into contact with the center section 6*a*2 and the side sections 6*a*3 of the second contacting portion 6*a* with an appropriate pressure, respectively, the first and the second shells 5 and 6 are reliably connected electrically.

The shell illustrated in FIGS. 3A and 3B may be used as a shell of the connector described in connection with FIGS. 1A to 1E and also as a shell of the connector described in connection with FIG. 2.

Figure 4A:
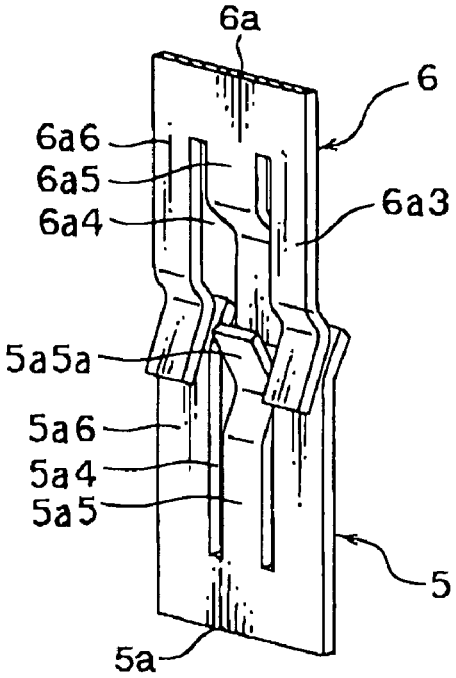
FIG. 4A is an enlarged perspective view of only a characteristic part of a second modification of the shell.
Figure 4B:
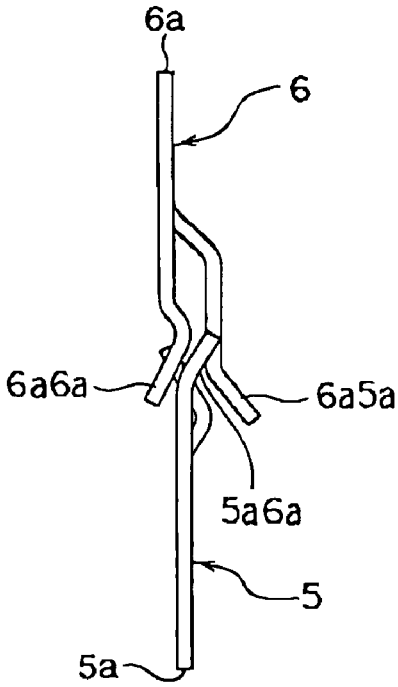
FIG. 4B is a side view corresponding to FIG. 4A.

Referring to FIGS. 4A and 4B, a second modification of the shell will be described. Similar parts are designated by like reference numerals and description thereof may be omitted.

The first contacting portion 5*a* is provided with two slits 5*a*4 cut from its upper end to form a center section 5*a*5 and a pair of side sections 5*a*6 on left and right sides. The center section 5*a*5 has a curved portion formed at a position slightly spaced from its end and curved rearward into a convex shape. A part between the end and the curved portion forms an inclined flat portion 5*a*5*a*. Each side section 5*a*6 has a flat portion 5*a*6*a* formed near its end and inclined rearward.

The second contacting portion 6*a* is provided with two slits 6*a*4 cut from its lower end to form a center section 6*a*5 and a pair of side sections 6*a*6 on left and right sides. The center section 6*a*5 is at first extended at a position near its base in parallel to the flat plate, inclined rearward, then extended in parallel to the flat plate, and inclined rearward to form a flat portion 6*a*5*a*. Each side section 6*a*6 has a curved portion formed at a position slightly spaced from its end and curved rearward into a convex shape. A part between the end and the curved portion forms an inclined flat portion 6*a*6*a*.

When the inclined flat portions 5*a*5*a* and 5*a*6*a* of the first contacting portion 5*a* are brought into contact with the inclined flat portions 6*a*5*a* and 6*a*6*a* of the second contacting portion 6*a*, the first and the second contacting portions 5*a* and 6*a* are easily guided by each other.

The shell illustrated in FIGS. 4A and 4B may be used as a shell of the connector described in connection with FIGS. 1A to 1E and also as a shell of the connector described in connection with FIG. 2.

Figure 5A:
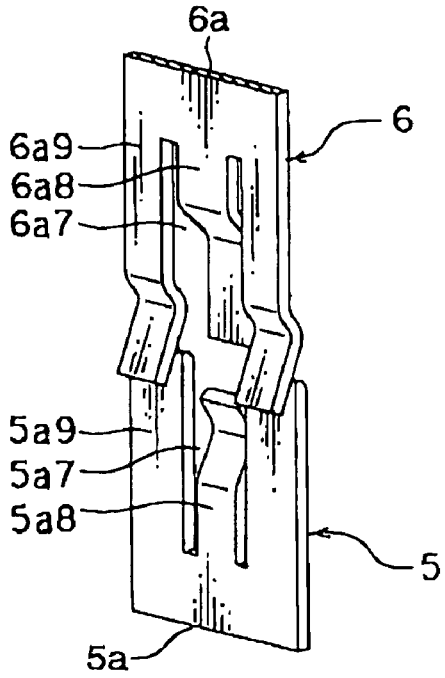
FIG. 5A is an enlarged perspective view of only a characteristic part of a third modification of the shell.
Figure 5B:
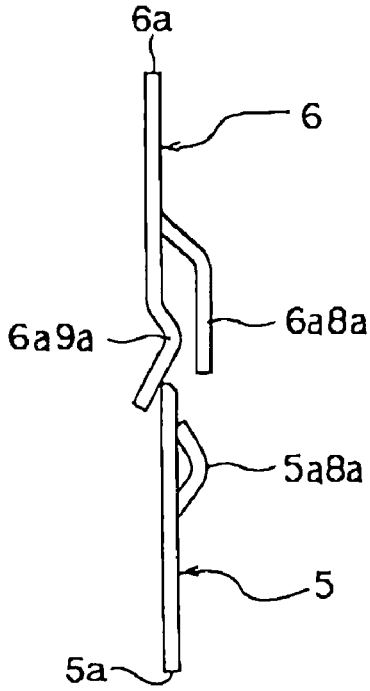
FIG. 5B is a side view corresponding to FIG. 5A.

Referring to FIGS. 5A and 5B, a third modification of the shell will be described. Similar parts are designated by like reference numerals and description thereof will be omitted.

The first contacting portion 5*a* is provided with two slits 5*a*7 cut from its upper end to form a center section 5*a*8 and a pair of side sections 5*a*9 on left and right sides. The center section 5*a*8 has a protruding portion 5*a*8*a* formed at a position slightly spaced from its end and curved rearward into a convex shape. Each side section 5*a*9 has a flat shape. The protruding portion 5*a*8*a* has a peak point positioned below an end of each side section 5*a*9.

The second contacting portion 6*a* is provided with two slits 6*a*7 cut from its lower end to form a center section 6*a*8 and a pair of side sections 6*a*9 on left and right sides The center section 6*a*8 is inclined rearward from its intermediate portion and then extended in parallel to the flat plate to form a flat portion 6*a*8*a*. Each side section 6*a*9 is curved rearward into a convex shape in the vicinity of its end to form a protruding portion 6*a*9*a*. Each protruding portion 6*a*9*a* has a peak point positioned above an end of the center section 6*a*8.

Therefore, when the first and the second contacting portions 5*a* and 6*a* are brought into contact with each other, the timing when the peak points of the protruding portions 6*a*9*a* are brought into contact with the ends of the side sections 5*a*9 is different from the timing when the peak point of the protruding portion 5*a*8*a* is brought into contact with the end of the center section 6*a*8. Thus, there is a time lag between these timings. As a consequence, the first and the second shells 5 and 6 are connected with light force (zero insertion force).

The shell illustrated in FIGS. 5A and 5B may be used as a shell of the connector described in connection with FIGS. 1A to 1E and also as a shell of the connector described in connection with FIG. 2.

Figure 6A:
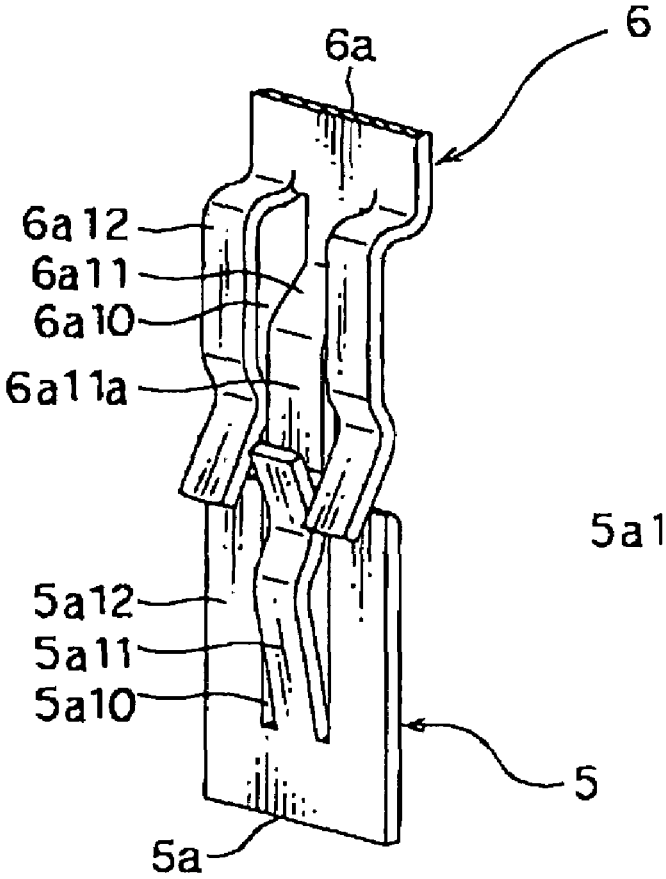
FIG. 6A is an enlarged perspective view of only a characteristic part of a fourth modification of the shell.
Figure 6B:
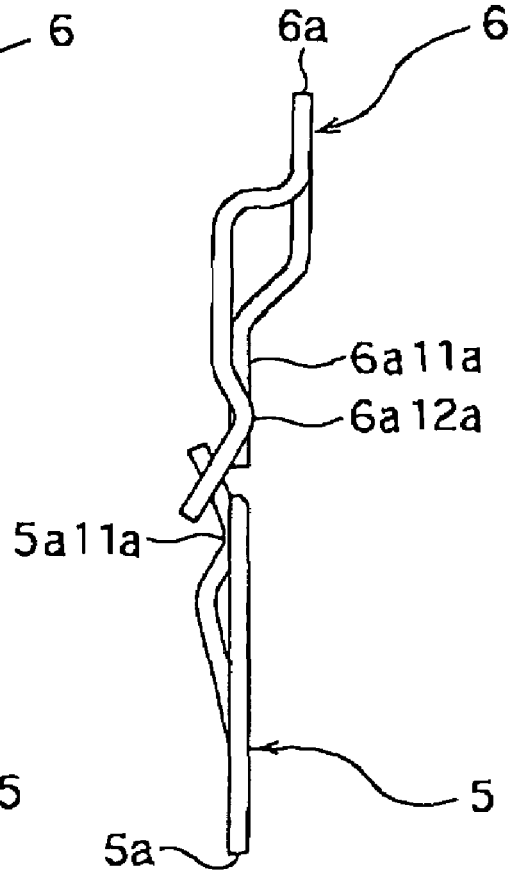
FIG. 6B is a side view corresponding to FIG. 6A.

Referring to FIGS. 6A and 6B, a fourth modification of the shell will be described. Similar parts are designated by like reference numerals and description thereof may be omitted.

The first contacting portion 5*a* is provided with two slits 5*a*10 cut from its upper end to form a center section 5*a*11 and a pair of side sections 5*a*12 on left and right sides. The center section 5*a*11 is at first inclined forward from its base, then curved rearward in the middle to be inclined rearward, and then inclined forward to form a protruding portion 5*a*11*a*. Each side section 5*a*12 has a flat shape.

The second contacting portion 6*a* is provided with two slits 6*a*10 cut from its lower end to form a center section 6*a*11 and a pair of side sections 6*a*12 on left and right sides. The center section 6*a*11 is at first inclined forward at a position slightly spaced from its base and then extended in parallel to the flat plate to form a flat portion 6*a*11*a*. Each side section 6*a*12 is gently curved forward from its base in a generally perpendicular direction, then gently curved downward in a generally perpendicular direction to extend in parallel to the flat plate, then curved rearward, and inclined forward to form a protruding portion 6*a*12*a*.

A plane on which a peak point of the protruding portion 5*a*11*a* is brought into contact with the flat portion 6*a*11*a* is flush with a plane on which peak points of the protruding portions 6*a*12*a* are brought into contact with the side sections 5*a*12. Therefore, the first and the second contacting portions 5*a* and 6*a* can be contacted with each other on the same plane so that the contacting portions are reduced in thickness.

The shell illustrated in FIGS. 6A and 6B may be used as a shell of the connector described in connection with FIGS. 1A to 1E and also as a shell of the connector described in connection with FIG. 2.

In each of the exemplary embodiments and the modifications mentioned above, both of the first and the second contacting portions 5*a* and 6*a* are elastically deformable. However, the connector according to this invention may be modified in design so that only one of the first and the second contacting portions 5*a* and 6*a* is elastically deformable.

Hereinafter, various exemplary modes of embodying this invention will be given

1. A connector comprising a contact 4, a housing holding the contact 4, and a shell covering the contact 4 and the housing 2, wherein the housing 2 includes a protecting portion 2*c* or 2*d*, and wherein the shell comprises:

a first shell 5 which includes a first contacting portion 5*a*; and a second shell 6 which includes a second contacting portion 6*a* brought into contact with the first contacting portion 5 in the protecting portion 2*c* or 2*d*.

2. The connector according to the first mode, wherein the protecting portion 2*c* is formed into a tubular shape having a generally rectangular section.

3. The connector according to the first mode, wherein the protecting portion 2*d* defines a groove therein having a generally U-shaped section 4. The connector according to the first mode, wherein at least one of the first and the second contacting portions 5*a* and 6*a* has elasticity.

5. The connector according to the first mode, wherein each of the first and the second contacting portions 5*a* and 6*a* is formed into a trifurcated shape.

6. The connector according to the first mode, wherein each of the first and the second contacting portions 5*a* and 6*a* includes a center section and a pair of side sections disposed on opposite sides of the center section.

7. The connector according to the sixth mode, wherein the second contacting portion 6*a* has a structure in which the center section is disposed nearer to the housing 2 than the side sections, and wherein the first contacting portion 5*a* is disposed in correspondence to a position between the side sections and the center section of the second contacting portion 6*a*.

8. The connector according to the seventh mode, wherein the center section of the first contacting portion 5*a* includes a part deformed towards the housing 2.

9. The connector according to the seventh mode, wherein the center section of the first contacting portion 5*a* has a flat shape.

10. The connector according to the seventh mode, wherein each of the side sections of at least one of the first and the second contacting portions 5*a* and 6*a* includes a part inclined so as to guide mutual contact between the first and the second contacting portions 5*a* and 6*a*.

11. The connector according to the sixth mode, wherein each of the first and the second contacting portions 5*a* and 6*a* has a structure in which the center section is substantially flush with the side sections, and wherein at least one of the center sections of the first and the second contacting portions 5*a* and 6*a* includes a part inclined so as to guide mutual contact between the first and the second contacting portions 5*a* and 6*a*.

12. The connector according to the sixth mode, wherein each of the first and the second contacting portions 5*a* and 6*a* has a structure in which the center section is substantially flush with the side sections, and wherein each of the side sections of at least one of the first and the second contacting portions 5*a* and 6*a* includes a part inclined so as to guide mutual contact between the first and the second contacting portions 5*a* and 6*a*.

Hereinafter, various exemplary effects of this invention will be described.

1. The housing has the protecting portion. The first and the second contacting portions of the first and the second shells are brought into contact with each other in the protecting portion. Therefore, both of the first and the second contacting portions are hardly subjected to unnecessary external force and can be prevented from undesired deformation.

2. Each of the first and the second contacting portions has a trifurcated shape. At least one of the first and the second contacting portions has elasticity. Therefore, the first and the second contacting portions can be reliably brought into contact at three positions.

3. The protecting portion is formed into a tubular shape having a generally rectangular section. Therefore, each of the first and the second contacting portions is protected with its four sides surrounded by the protecting portion.

4. The protecting portion may be formed as a groove having a generally U-shaped section. Therefore, the three sides of each of the first and the second contacting portions are protected and the state of contact therebetween can be visually observed on one side.

While the present invention has thus far been described in connection with the exemplary embodiments thereof, it will readily be possible for those skilled in the art to put this invention into practice in various other manners.

What is claimed is:

1. A connector comprising a contact, a housing holding the contact, and a shell covering the contact and the housing, wherein the housing includes a protecting portion, wherein the shell comprises:

a first shell which includes a first contacting portion; and a second shell which includes a second contacting portion brought into contact with the first contacting portion in the protecting portion, wherein each of the first and the second contacting portions has elasticity and includes a center section and a pair of side sections which are disposed on opposite sides of the center section in a first direction, respectively, and wherein the center section and each of the side sections have contacting surfaces, respectively, which are faced opposite to each other in a second direction perpendicular to the first direction.

2. The connector according to claim 1, wherein the protecting portion is formed into a tubular shape having a generally rectangular section.

3. The connector according to claim 1, wherein the protecting portion defines a groove therein having a generally U-shaped section.

4. The connector according to claim 1, wherein each of the first and the second contacting portions is formed into a trifurcated shape.

5. The connector according to claim 1, wherein the second contacting portion has a structure in which the center section is disposed nearer to the housing than the side sections, and wherein the first contacting portion is disposed in correspondence to a position between the side sections and the center section of the second contacting portion.

6. The connector according to claim 5, wherein the center section of the first contacting portion includes a part deformed towards the housing.

7. The connector according to claim 5, wherein the center section of the first contacting portion has a flat shape.

8. The connector according to claim 5, wherein each of the side sections of at least one of the first and the second contacting portions includes a part inclined so as to guide mutual contact between the first and the second contacting portions.

9. The connector according to claim 1, wherein each of the first and the second contacting portions has a structure in which the center section is substantially flush with the side sections, and wherein at least one of the center sections of the first and the second contacting portions includes a part inclined so as to guide mutual contact between the first and the second contacting portions.

10. The connector according to claim 1, wherein each of the first and the second contacting portions has a structure in which the center section is substantially flush with the side sections, and wherein each of the side sections of at least one of the first and the second contacting portions includes a part inclined so as to guide mutual contact between the first and the second contacting portions.

11. The connector according to claim 1, wherein the side sections of the first contacting portion are positioned substantially flush with the center section of the first contacting portion in the second direction, and wherein the side sections of the second contacting portion are positioned different form the center section of the second contacting portion in the second direction.

* * * * *